US005333792A

United States Patent [19]

Wang

[11] Patent Number: 5,333,792

[45] Date of Patent: Aug. 2, 1994

[54] A SPRAY GUN INCLUDING A GOVERNING RING ASSEMBLY TO PROVIDE SEVERAL DIFFERENT WATER FLOW PATTERNS

[76] Inventor: King-Yuan Wang, No. 1, Lane 288, Sec 1, Lu ha Road, Lu Kan Town, Changhua, Taiwan

[21] Appl. No.: 87,253

[22] Filed: Jul. 8, 1993

[51] Int. Cl.[5] ..... B05B 1/16; B05B 1/32

[52] U.S. Cl. ..... 239/440; 239/441; 239/444; 239/457; 239/526

[58] Field of Search ..... 239/526, 525, 457, 456, 239/451, 443, 438, 436, 440, 441, 446, 449

[56] References Cited

U.S. PATENT DOCUMENTS

| | | | |
|---|---|---|---|
| 3,514,042 | 5/1970 | Freed | 239/438 X |
| 3,791,584 | 2/1974 | Drew et al. | 239/456 X |
| 4,618,100 | 10/1986 | White et al. | 239/526 X |
| 4,785,998 | 11/1988 | Takagi | 239/440 |
| 4,909,443 | 3/1990 | Takagi | 239/526 X |
| 4,955,546 | 9/1990 | Liaw | 239/526 X |
| 4,986,477 | 1/1991 | Roman | 239/525 X |

FOREIGN PATENT DOCUMENTS

| | | | |
|---|---|---|---|
| 574527 | 4/1959 | Canada | 239/456 |

*Primary Examiner*—Andres Kashnikow
*Assistant Examiner*—Lesley D. Morris
*Attorney, Agent, or Firm*—Beveridge, DeGrandi, Weilacher & Young

[57] ABSTRACT

An improved spray gun includes a governing ring, wherein an inner thread and plural guiding ribs are installed in the center of the governing ring. A netted water flow room having a water outlet is positioned at the guiding ribs of the governing ring, and a water stop room is positioned proximate the water outlet in the top of the netted water flow room. A coning foggy water flow room is installed at the top of the water stop room. A netted cover is positioned over the foggy water flow room, wherein the netted cover is connected to the governing ring by a connecting cap. An outer thread in the end of the governing ring fits with the inner thread of the connecting cap. A center stem is installed within the governing ring, and two water stop rings are mounted on the center stem, one on each side of a water outlet in the middle of the center stem. This combination of elements is capable of governing and controlling water stopping directly, but it also provides eight different water flow controls in one single spray gun.

7 Claims, 4 Drawing Sheets

A SPRAY GUN INCLUDING A GOVERNING RING ASSEMBLY TO PROVIDE SEVERAL DIFFERENT WATER FLOW PATTERNS

BACKGROUND OF THE INVENTION

This invention relates to a spray gun which focuses on avoiding the inconvenience of installing a switch in the water flow pipe for stopping water flow. The construction of the present invention allows the operator to stop the water flow. By governing and changing the position of a center stem and a governing ring, the water can be sprayed out of or allowed to flow out from a foggy water flow room, a netted water flow room or a space between the governing ring and the netted water flow room. Eight different water flow patterns can be provided by the spray gun of the present invention.

Spray guns are becoming more and more important in daily life. Spray guns can be used for spraying water on flowers and plants or for washing cars and furniture. The water flow requirements are different for the different uses. For example, gardening requires disperse and foggy water; washing and cleaning require concentrating and powerful water flow. Therefore, a multi-usage spray gun which can provide different water flow patterns for different people in different occasions is needed.

Moreover, the prior art spray gun for gardening can not stop water flow unless a switch has been installed in the water pipe connected to the spray gun or unless the tap has been turned off.

The inventor has been endeavoring for many years to design and improve the spray gun of the present invention, which spray gun eliminates the aforesaid drawbacks effectively.

SUMMARY OF THE INVENTION

It is therefore the main object of the present invention to provide an improved spray gun which has a governing ring, wherein the inner thread and a ring flange are installed in the center. A netted water flow room having a water outlet is positioned within the governing ring, and a water stop room is positioned proximate the water outlet in the top of the netted water flow room where an inner guiding rib is positioned. A coning foggy water flow room is installed at the top of the water stop room. A netted cover is positioned over the foggy water flow room, the netted cover is connected to the governing ring by a connecting cap. The outer thread installed in the end of the governing ring fits with the inner thread of the connecting cap. A center stem is installed within the governing ring, and two water stop rings are mounted on both sides of a water outlet in the middle of the center stem. This combination of elements is capable of governing and controlling water stopping directly, but it also provides eight different water flow controls in one single spray gun.

It is another object of the present invention to provide an improved spray gun which has two water stop rings, one installed on each side of the water outlet for closing the water stop room, so as to control the water stopping. This function is not performed by the prior art spray guns.

It is a further object of the present invention to provide an improved spray gun whose parts (e.g., water flow room, water stop room, foggy water flow room, netted cover and so on) are manufactured respectively before they are assembled together, so as to simplify the process of manufacturing.

DETAILED DESCRIPTION OF THE PREFERRED EMBODIMENT

Figure 1:
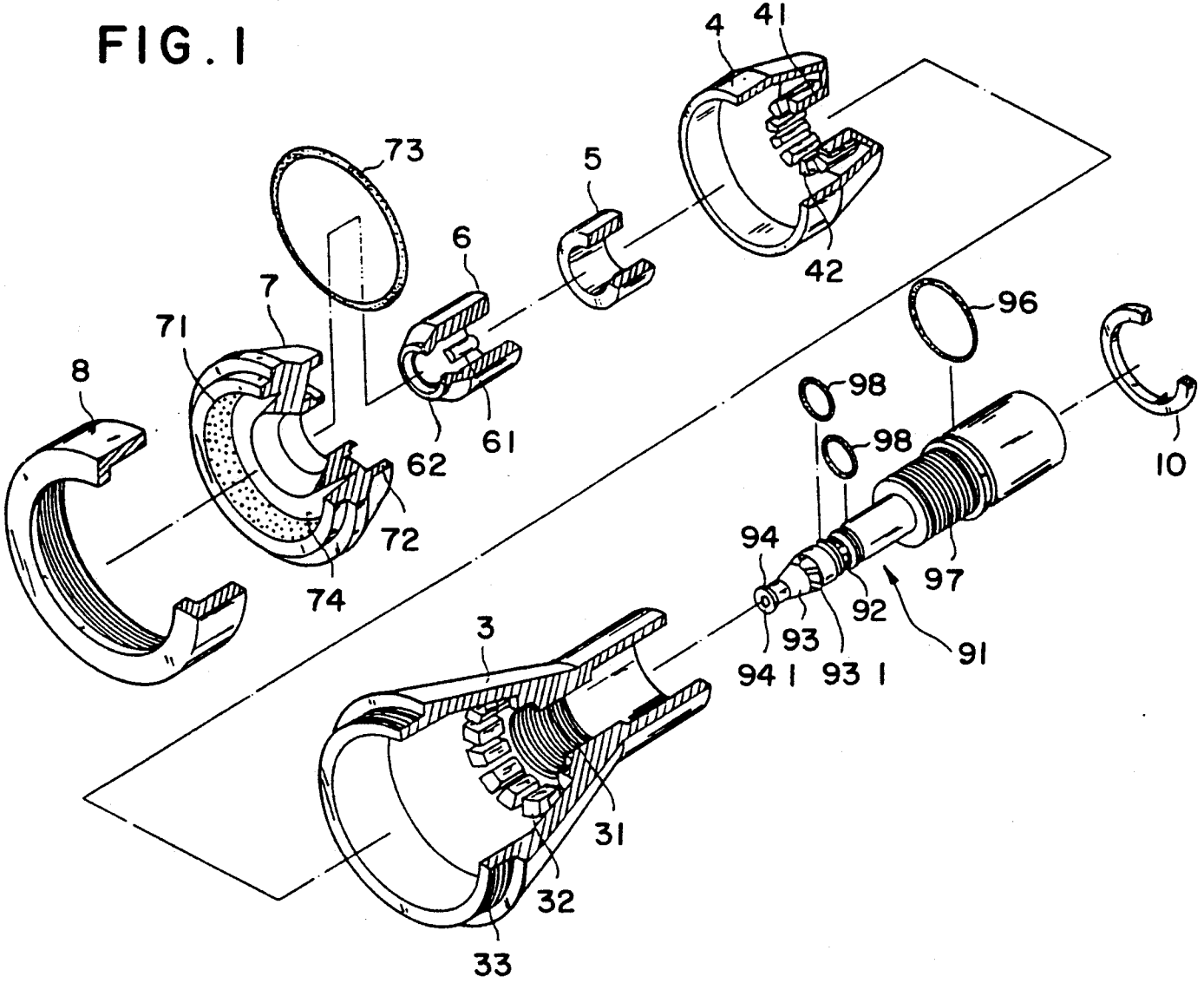
FIG. 1 is a three-dimensional exploded view of the spray gun in accordance with the present invention.
Figure 2:
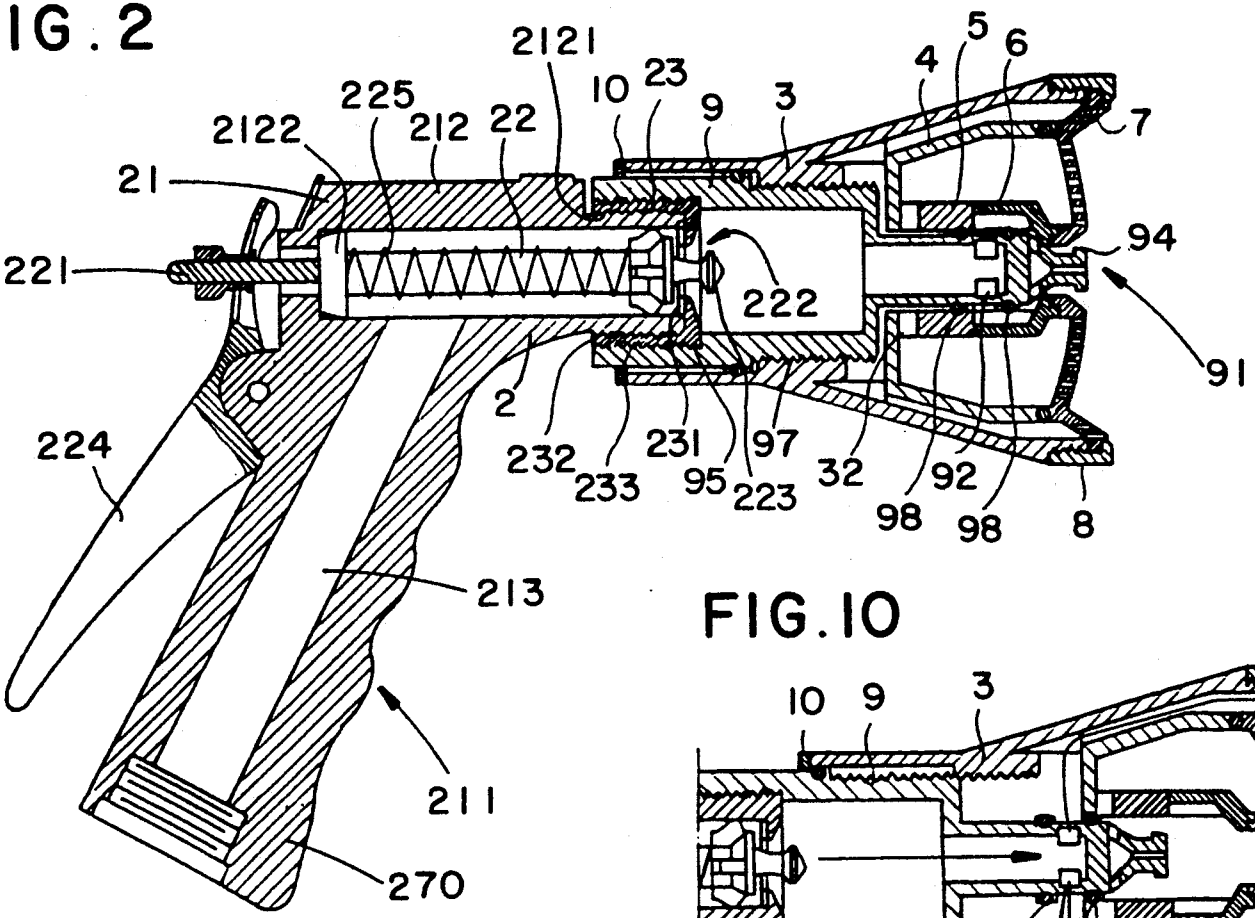
FIG. 2 is a sectional schematic view of the assembled spray gun of the present invention.

Referring to FIGS. 1 and 2, an improved spray gun is illustrated which is comprised of a handle 211, a body cover 270 and a hollow water way 213. A covering 212 is provided whereon thread 2121 is mounted. A groove hole 2122 is defined in the handle body 21. Thread 221 and valve 222 are mounted on opposite ends of the handle body. The valve 222 has a guiding pillaret 223 installed in the front edge, and the thread 221 is screwed to trigger 224 through groove hole 2122. The trigger 224 has its middle section connected to handle 211. A valve stem 22 has a spring 225 installed around it, and a valve opening 231 is defined in the front of the valve stem 22. The valve cap 23 includes inside and outside threads 232 and 233.

The valve stem 22 includes threads 2121 which are screwed to inner threads 232 of the valve cap 23 of the main body 2. A governing ring 3, a netted water flow room 4, a water stop room 5, a foggy water flow room 6, a netted cover 7 with several meshes 71 and a connecting cap 8 are installed outside of the valve cap 23, in the direction of water flow. A one-end open center stem 91 is mounted in the governing ring. The center stem 91 includes a symmetric water outlet 92 in the center, a cone 93 and water outlet 931 in front of the closed end. A control protuberance 94 of the valve 9 extends from the water outlet 941 in front of cone 93. A sleeve ring 10 is provided at the end of the valve 9 opposite from the control protuberance 94.

The characteristics of the present invention are described in the following section.

The governing ring 3 has two open spaces on both sides. A thread 31 is installed inside the governing ring 3. A guiding rib 32 is included in the governing ring 3, and an outer thread 33 is mounted on one side of the governing ring 3.

The netted water flow room 4 has two open spaces inside on both sides, a bottom end 41 positioned at the top of guiding rib 32 in the center of the governing ring 3, and a protuberant rib in the center for forming a water outlet 42.

The rim of water stop room 5 is a closed ring which is positioned in front of water outlet 42 of the netted water flow room 4, when viewed in the direction of water flow.

The foggy water flow room 6 has two open spaces inside on both ends. A guiding rib 61 in the bottom of the foggy water flow room 6 is positioned in the top of water stop room 5, and a coning opening 62 is installed in the front of the foggy water flow room 6.

The netted cover 7 has its outer rim positioned near the top of the outer thread 33 in the front part of the governing ring 3. A ring flange 72 is provided inside the netted cover 7, a water stop ring 73 is connected to the top of the netted water flow room 4, an expanding opening 74 is provided in the center of the cover 7. The center bottom of the netted cover 7 is positioned in front of the foggy water flow room 6, when viewed in the direction of water flow.

The connecting cap 8 can be screwed to the outer thread 33 in the front part of the governing ring 3 so as to connect the netted cover 7 in the top rim of governing ring 3. The valve body 9 is of a ladder-shaped construction which is installed inside the governing ring 3, the netted water flow room 4, the water stop room and the foggy water flow room 6. The valve 9 has an inside thread 95 installed in the bottom for screwing to the outer thread 233 of the valve cap 23 of the main body 2. A water stop ring 96 is provided around the outer rim of the valve 9. This water stop ring 96 acts together with the inside wall of governing ring 3 for stopping water. A thread section 97 around the center outer rim of the valve 9 is matched with the center thread section 31 inside the governing ring 3 for adjusting the rotation of the governing ring. A symmetric water outlet 92 is provided in the middle of the center stem 91, wherein the water outlet 92 is mounted at the front of valve body 9 (when viewed in the water flow direction), and two water stop rings 98 are installed, one on each side of the water outlet 92.

The sleeve ring 10 can be used for sealing the connection of the rim of the governing ring 3 and the outer rim of the valve body 9.

Referring to FIGS. 2, 3, 4, 5, 6, 7, 8, 9 and 10, the arrangements for providing the various flow patterns for the spray gun of the present invention are illustrated. The arrows in these Figures show the water flow path.

Figure 10:
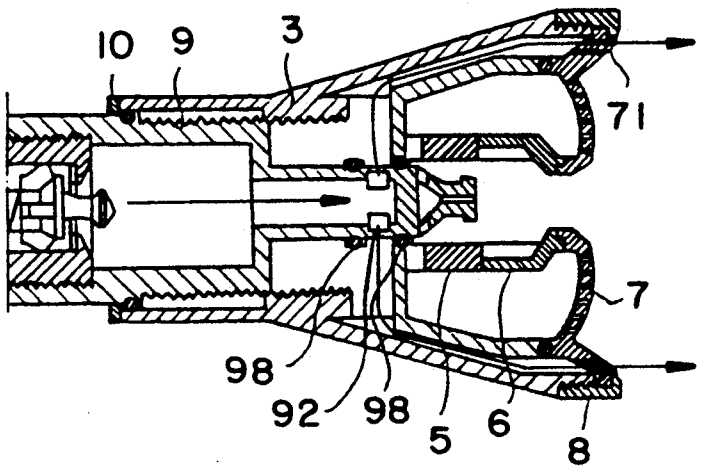
FIG. 10 is an operating schematic view of the spray gun of the present invention in a strong full water flow configuration.
Figure 3:
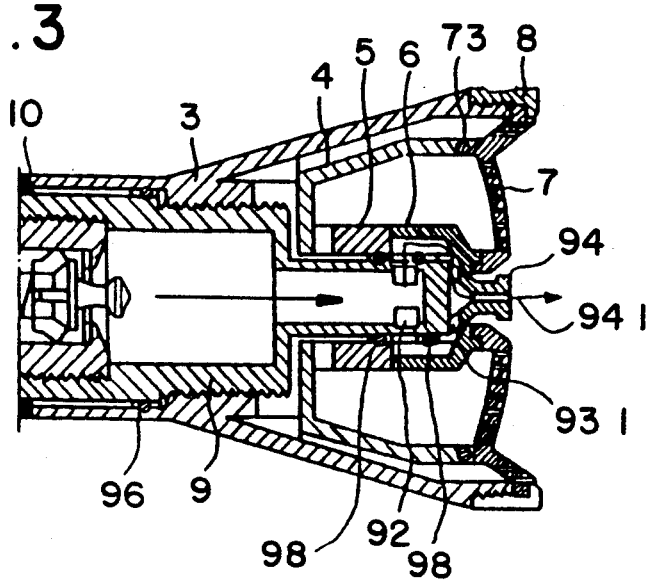
FIG. 3 is an operating schematic view of the spray gun of the present invention in a foggy water flow configuration.
Figure 4:
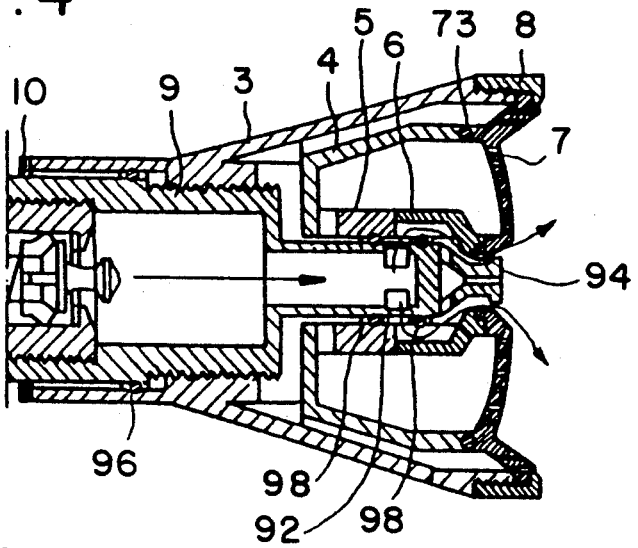
FIG. 4 is an operating schematic view of the spray gun of the present invention in a dispersed water flow configuration.
Figure 5:
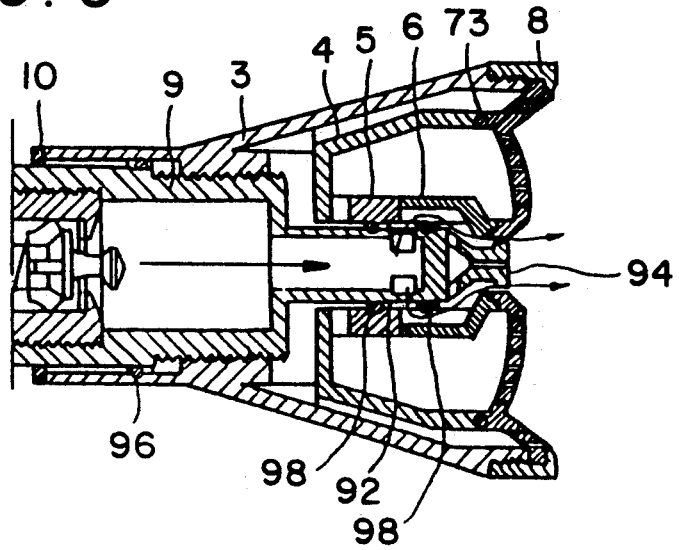
FIG. 5 is an operating schematic view of the spray gun of the present invention in a direct flow configuration.
Figure 8:
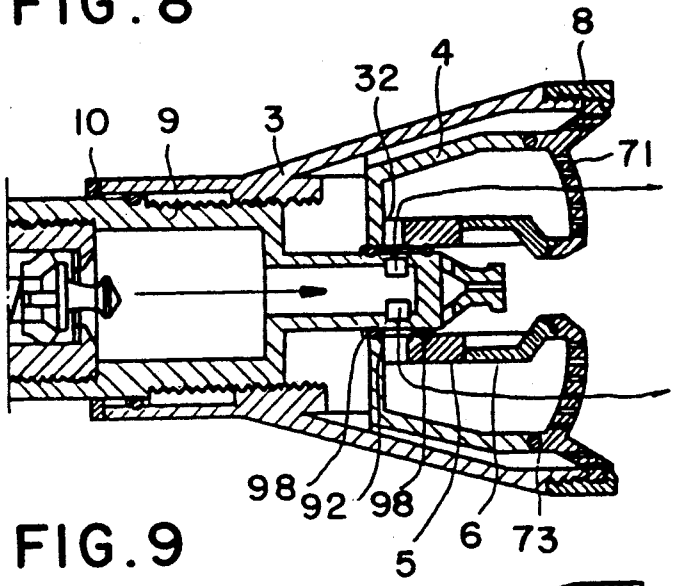
FIG. 8 is an operating schematic view of the spray gun of the present invention in a strong netted water flow configuration.
Figure 9:
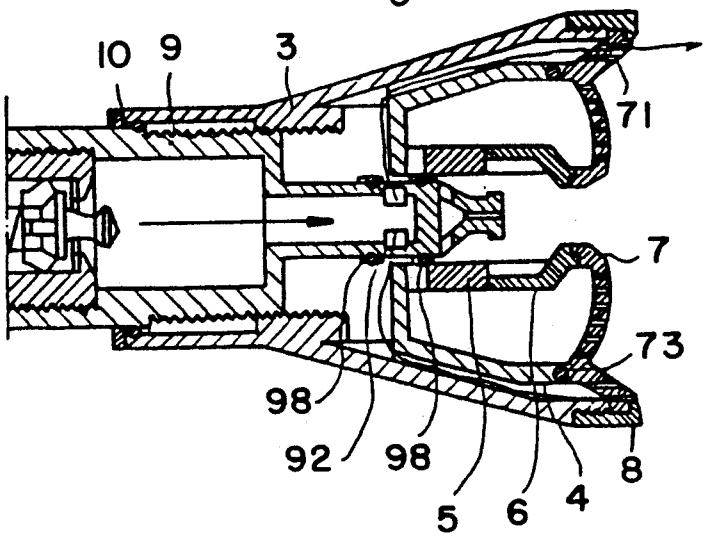
FIG. 9 is an operating schematic view of the spray gun of the present invention in a soft full water flow configuration.
Figure 6:
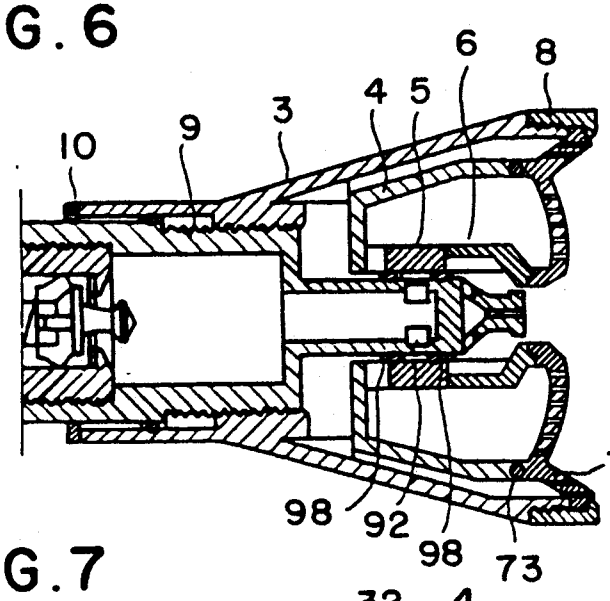
FIG. 6 is an operating schematic view of the spray gun of the present invention in a water stopping configuration.
Figure 7:
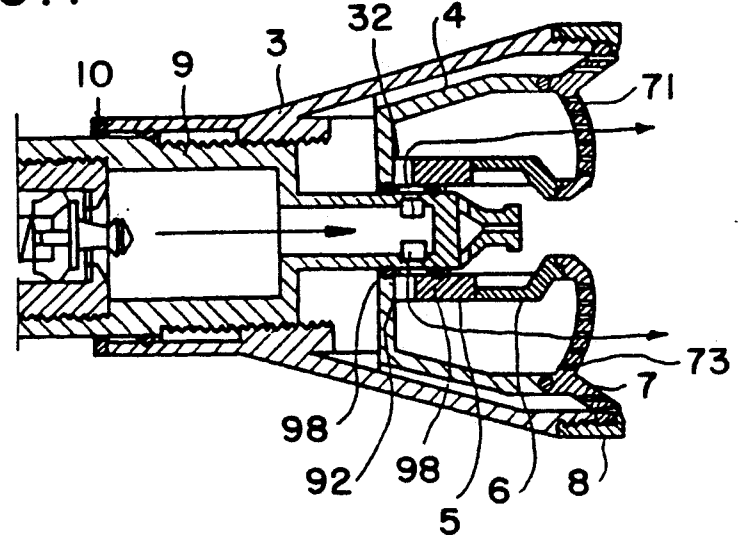
FIG. 7 is an operating schematic view of the spray gun of the present invention in a soft netted water flow configuration.

The trigger 224 of the main body 2 drives valve stem 22 leaving valve opening 231 of the valve cap 23 open for guiding water under pressure into valve body 9. The governing ring 3 can be screwed so as to connect its center thread section 31 with the thread section 97 in the outer rim of the valve body 9 for rotating left and right. Therefore, center stem 91 of valve body 9 and the inner spaces of governing ring 3, netted water flow room 4, water stop room 5 and foggy water flow room 6 can be positioned for providing eight different forms of water flow as follows: foggy flow (as shown in FIG. 3), dispersed flow (as shown in FIG. 4), straight flow (as shown in FIG. 5), water off (as shown in FIG. 6), netted soft flow (as shown in FIG. 7), netted strong flow (as shown in FIG. 8), soft full flow (as shown in FIG. 9) and strong full flow (as shown in FIG. 10). Referring to FIG. 6, the inner rim of the closed water stop room 5 is positioned in the middle of the netted water flow room 4 and the foggy water room 6. The openings to the netted water flow room 4 and the foggy water flow room 6 are covered by the water stop rings 98 mounted respective on both sides of the water outlet 92, thereby enabling the water to be shut off effectively by rotating valve body 9 and governing ring 3. The improved spray gun of the present invention completely eliminates the drawbacks of the prior art spray gun which can not stop the water directly, unless a switch is installed in the pipe connected to the spray gun.

According to the above description, it is therefore an object of the present invention to provide an improved spray gun which stops the water flow directly.

It is another object of the present invention to provide an improved spray gun which can control and spray eight different forms of water flow patterns.

What is claimed is:

1. A spray gun for providing a plurality of liquid flow patterns, comprising:

a handle having a main body, the handle defining a hollow channel to allow liquid to pass through the spray gun;

a valve stem disposed in the hollow channel to stop liquid flow through a main opening defined in the main body of the handle;

a trigger connected to the handle and to the valve stem, the trigger driving the valve stem so as to allow liquid to pass through the main opening when the valve stem is in a first position and to stop liquid flow when the valve stem is in a second position;

a governing ring attached to an end of the main body of the handle which includes the main opening, the governing ring including plural guiding ribs;

a valve body attached to the governing ring, the valve body including a center stem extending beyond a portion of the valve body where the valve body is attached to the governing ring, based on a direction of liquid flow, wherein an outlet is defined between two stop rings on the center stem;

a netted water flow room arranged in the governing ring such that a bottom end of the netted water flow room is positioned at the guiding ribs of the governing ring, the netted water flow room being provided with an outlet;

a water stop room arranged in the netted water flow room beyond the outlet in the netted water flow room in the direction of liquid flow;

a foggy water flow room arranged beyond the water stop room in the direction of liquid flow, the foggy water flow room defining a coning opening; and a netted cover connected to the netted water flow room, wherein the position of the outlet in the valve body and the two stop rings of the valve body may be adjusted with respect to the governing ring, the outlet in the netted water flow room, and the coning opening in the foggy water flow room so as to change the liquid flow pattern from the nozzle.

2. The spray gun according to claim 1, wherein the water stop room and the foggy water flow room are arranged in the governing ring.

3. The spray gun according to claim 2, wherein the netted cover is arranged in the governing ring.

4. The spray gun according to claim 1, wherein the foggy water flow room is arranged in the netted water flow room.

5. The spray gun according to claim 1, further including a connecting cap to connect the netted cover to the governing ring.

6. The spray gun according to claim 1, further including a sleeve ring for sealing the governing ring to the valve body.

7. The spray gun according to claim 1, wherein external threads on the valve body engage with internal threads of the governing ring to thereby connect the valve body to the governing ring.

* * * * *